US005548205A

United States Patent [19]

Monticelli

[11] Patent Number: 5,548,205

[45] Date of Patent: Aug. 20, 1996

[54] METHOD AND CIRCUIT FOR CONTROL OF SATURATION CURRENT IN VOLTAGE REGULATORS

[75] Inventor: Dennis M. Monticelli, Fremont, Calif.

[73] Assignee: National Semiconductor Corporation, Santa Clara, Calif.

[21] Appl. No.: 480,958

[22] Filed: Jun. 7, 1995

Related U.S. Application Data

[63] Continuation of Ser. No. 359,948, Dec. 20, 1994, abandoned, which is a continuation of Ser. No. 158,938, Nov. 24, 1993, abandoned.

[51] Int. Cl.[6] ..... G05F 1/44

[52] U.S. Cl. ..... 323/274; 323/280; 323/281

[58] Field of Search ..... 323/273, 274, 323/280, 281, 282, 284, 289, 351

[56] References Cited

U.S. PATENT DOCUMENTS

| | | | |
|---|---|---|---|
| 4,760,434 | 7/1988 | Tsuzuki et al. | 323/284 x |
| 4,794,277 | 12/1988 | Holland | 307/296 R |
| 5,119,263 | 6/1992 | Gariboldi et al. | 361/18 |
| 5,132,556 | 7/1992 | Cheng | 307/296.7 |

OTHER PUBLICATIONS

National Semiconductor Low Voltage Databook, "LM1577/LM2577 Series Simple Switcher Step-up Voltage Regulator", 1992 Edition, cover page, pp. i–ii and 4–121 to 4–136. Block and Schematic Diagrams of National Semiconductor LM1577 pp. 1 to 9. Jun. 23, 1987.

*Primary Examiner*—Peter S. Wong
*Assistant Examiner*—Y. Jessica Han
*Attorney, Agent, or Firm*—Limbach & Limbach L.L.P.

[57] ABSTRACT

A voltage regulator employs a PNP output transistor of vertical construction, which operates as a linear control element in a feedback controlled circuit which is formed in a substrate. A differential amplifier has one input coupled to a voltage reference and another input coupled via feedback from a resistive voltage divider connected between common and the output of the voltage regulator. A parasitic NPN transistor, which is merged physically and thermally with the structure of the PNP output transistor, senses the onset of output transistor saturation and re-routes the majority of the excess base current drive to a feedback control node. The feedback control node retards total excess drive via a reduction in drive amplifier gain and bandwidth thereby assuring good stability of feedback loop operation during all phases of saturation, without the need for additional frequency compensating elements.

20 Claims, 5 Drawing Sheets

METHOD AND CIRCUIT FOR CONTROL OF SATURATION CURRENT IN VOLTAGE REGULATORS

This is a continuation of application Ser. No. 08/359,948 filed on Dec. 20, 1994 (now abandoned), which is a continuation of application Ser. No. 08/158,938 filed on Nov. 24, 1993 (now abandoned).

BACKGROUND OF THE INVENTION

1. Field of Invention

The present invention relates to the field of voltage regulators and more specifically to the field of methods and circuits for the control of current levels during output transistor saturation in vertical structure voltage regulators.

2. Description of Related Art

Typical integrated circuit (IC) voltage regulators employ lateral PNP structures. A schematic diagram of one such voltage regulator 10 is shown in FIG. 1. One desireable operational characteristic of a voltage regulator is the prevention of surges in the quiescent current drawn by a voltage regulator from a voltage source when the load across the voltage regulator output is non-existent or very light and the potential of the voltage source approaches the desired or set value of the voltage regulator output. In a case where the voltage source is a battery, such surges significantly accelerate the discharge of the battery.

Referring now to FIG. 1, in operation, an output transistor 12 through a first collector 14 powers an external load (not shown) connected between an output port 16 and common. When the output transistor 12 saturates, a transistor 18 conducts thereby adding sufficient current to the bias level of a transistor 32 to in turn retard the conduction level of a transistor 22. Transistor 18 is of lateral construction and embedded within the structure of output transistor 12, thus facilitating accurate sensing of the onset of saturation. A resistor 34 limits the level of clamping provided by transistor 32. A resistor 36 sets the bias at the base of transistor 32.

Retarding the conduction level of transistor 22 lowers, through a transistor 24, the current through the base of the output transistor 12, thereby regulating the depth of saturation of output transistor 12.

A capacitor 26 provides compensation for a feedback loop which is further described herein. In addition, a second collector 28 of the transistor 12 provides an alternate feedback loop which regulates the depth of saturation of the output transistor 12 through a transistor 30 and a transistor 20.

A voltage divider consisting of a resistor 38 and a resistor 40 provide feedback from the voltage output port 16. This feedback is connected to an inverting input 42 of a control amplifier 44. A non-inverting input 46 of the control amplifier 44 is connected to a voltage reference 48, the potential of which is used to set the desired potential at the voltage output port 16. An output 50 of the control amplifier 44 controls, in part, the base current of the transistor 22, which in turn through the transistor 24 and a resistor 52 further sets the base current of the output transistor 12. A current source 54 operates to bleed off leakage currents which might cause the output transistor 12 to conduct when transistor 22 is not conductive.

Because vertical construction does not provide for multiple collectors such as those utilized in the lateral voltage regulator 10, it would be desireable to provide a method and circuit which provides good control of the rise in operating current of a saturated output transistor in a vertical construction IC voltage regulator.

SUMMARY OF THE INVENTION

It is an object of the invention to provide a circuit for a vertical construction IC voltage regulator which limits the rise in current drawn by the voltage regulator from a voltage supply under light load or no load conditions when the potential of the voltage supply approaches the desired potential of the voltage regulator output.

It is a further object of the invention to provide a circuit for a vertical construction IC voltage regulator which is stable without special frequency compensation.

It is an additional object of the invention to provide a circuit for a vertical construction IC voltage regulator where a feedback sense device requires no additional die space.

These and other objects are achieved in a circuit configured as follows. A voltage regulator employs a PNP output transistor of vertical construction, which operates as a linear control element in a feedback controlled circuit which is formed in a substrate. Such a substrate may be contained within an integrated circuit. A control amplifier has one input coupled to a voltage reference and another input coupled to a feedback loop consisting of a resistive voltage divider connected between common and the output of the voltage regulator.

A parasitic NPN transistor, which is merged physically and thermally with the structure of the PNP output transistor, senses the onset of output transistor saturation and re-routes the majority of the excess base current drive to a feedback control node. The feedback control node retards total excess drive via a reduction in drive amplifier gain and bandwidth thereby assuring good stability of feedback loop operation during all phases of saturation, without the need for additional frequency compensating elements.

The above features and advantages of the present invention will become apparent from the following description and the appended claims taken in conjunction with the accompanying drawings in which like parts or elements are denoted by like reference numerals.

DETAILED DESCRIPTION OF THE INVENTION

Figure 1:
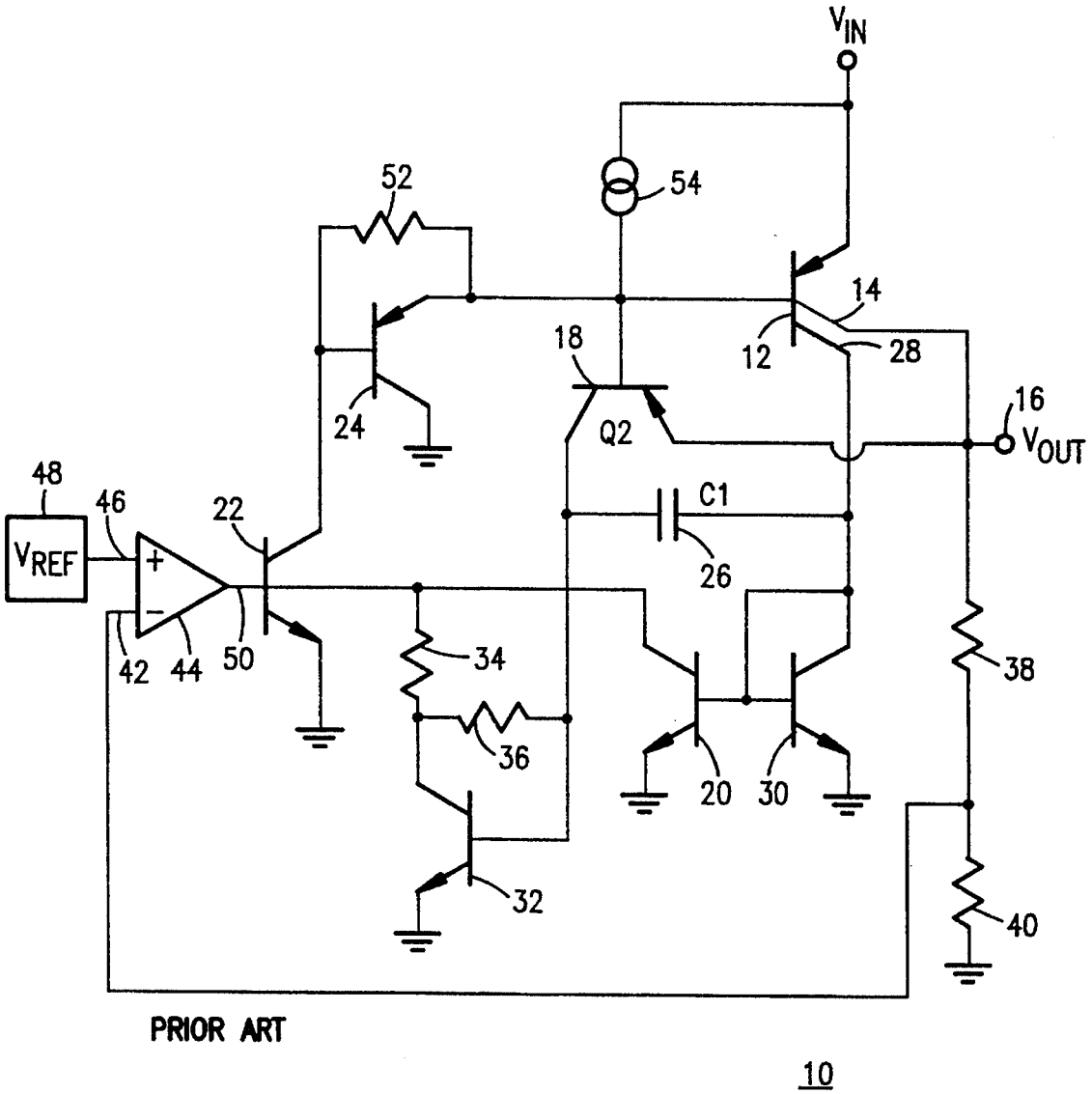
FIG. 1 is a schematic diagram illustrating a prior art voltage regulator circuit.
Figure 2:
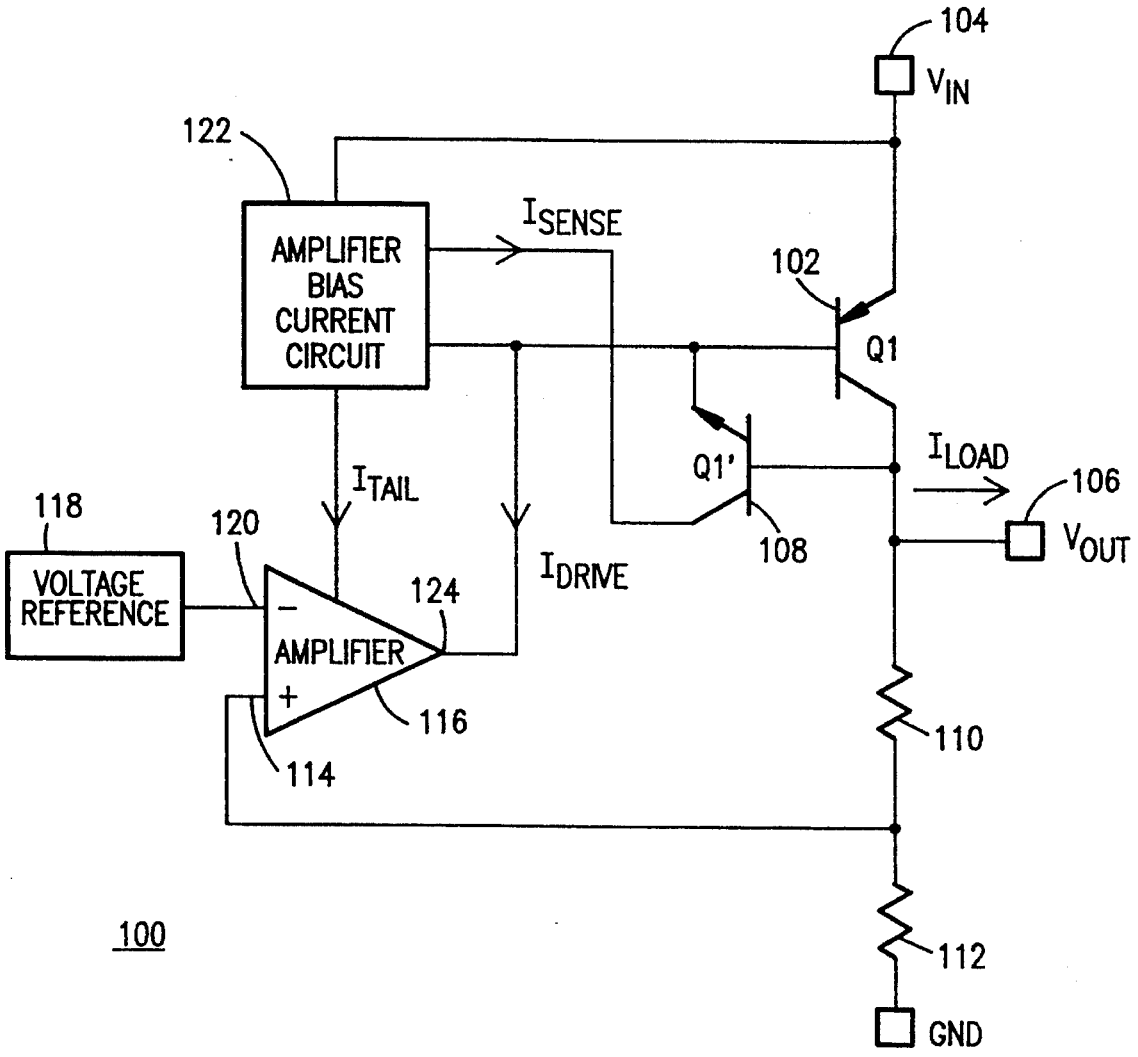
FIG. 2 is a combination block and schematic diagram illustrating a simplified version of the voltage regulator circuit of the invention.

FIG. 2 illustrates a simplified version of the voltage regulator circuit of the present invention. A voltage regulator 100 includes PNP output transistor 102 having its emitter connected to a voltage supply 104 and its collector connected to the junction of a voltage output port 106, the base of a parasitic transistor 108 and a resistor 110. A load (not shown) is typically connected between the voltage output port 106 and common (also known as "ground" potential). The resistor 110 together with a resistor 112 operates as a voltage divider which provides a feedback signal to a non-inverting input 114 of a control amplifier 116. A voltage reference 118, which reference is used to set the desired voltage at the port 106, is connected to an inverting input 120 of the control amplifier 116.

An amplifier bias current circuit 122, shown in block form in FIG. 2 (and detailed further herein) provides primary control of the bias for control amplifier 116. A sense current, $I_{SENSE}$, is drawn from amplifier bias current circuit 122 via the collector of the parasitic transistor 108.

In operation at equilibrium, since the base-emitter junction of the output transistor 102 is normally forward biased, current from the voltage supply 104 flows into the emitter of the output transistor 102 and then out of the collector of the output transistor 102.

Assuming a non-negligible external load between the voltage output port 106 and common and a nominal load due to the resistors 110 and 112, most of the current from the collector of the output transistor 102 flows through such external load.

In the preferred embodiment of the invention, the values of the resistor 110 and 112 are selected to draw only a nominal amount of current from the collector of the output transistor 102. The base of the parasitic NPN transistor 108 also draws negligible current from the collector of the output transistor 102.

In further detail, the output transistor 102 functions as a linear control element to provide, within limits, a substantially constant potential at the voltage output port 106 notwithstanding the amount current drawn by the load, $I_{LOAD}$.

When the potential of voltage supply 104 drops (for example, as a battery voltage supply decays) to a level that forces output transistor 102 to enter saturation, control amplifier 116 attempts to maintain output voltage 106 by increasing drive, $I_{DRIVE}$, to the base of output transistor 102. Since the magnitude of $I_{DRIVE}$ must be sufficiently large to drive the output transistor 102 to full output under conditions of high $I_{LOAD}$, the overall operating current surges well above the normal quiescent levels that would exist if there were a sufficient differential between the potential of the voltage supply 104 and the desired potential at the voltage output port 106. Thus, $I_{DRIVE}$ builds to maximum levels in saturation, regardless of the magnitude of $I_{LOAD}$. Under conditions of very light load, the surge in operating current can be orders of magnitude greater than the quiescent level.

The parasitic transistor 108, however, retards such a surge without deteriorating the voltage regulating ability of the circuit 100. In further detail, when the output transistor 102 is not saturated, the parasitic NPN transistor 108 is not forward biased. However, when the output transistor 102 first saturates, the bias at the base of the parasitic NPN transistor 108 rises to a potential above that of its emitter. This causes the parasitic NPN transistor 108 to be forward biased allowing transistor 108 to conduct, thereby rerouting the excess base portion of drive current, $I_{DRIVE}$,, to the amplifier bias current circuit 122. In further detail, control amplifier 116 begins to draw current from the emitter of transistor 108 in place of some of the current drawn from the base of output transistor 102. The amplifier bias current circuit 122 in turn responds to the negative feedback by retarding the currents within the control amplifier 116 in such a way as to reduce $I_{DRIVE}$ to an equilibrium level that represents only a modest amount relative to the amount of $I_{DRIVE}$ normally available. The retarded currents from the control amplifier 116 also result in reduced loop bandwidth and gain, thus ensuring good stability of the overall feedback loop during all phases of saturation.

Figure 3:
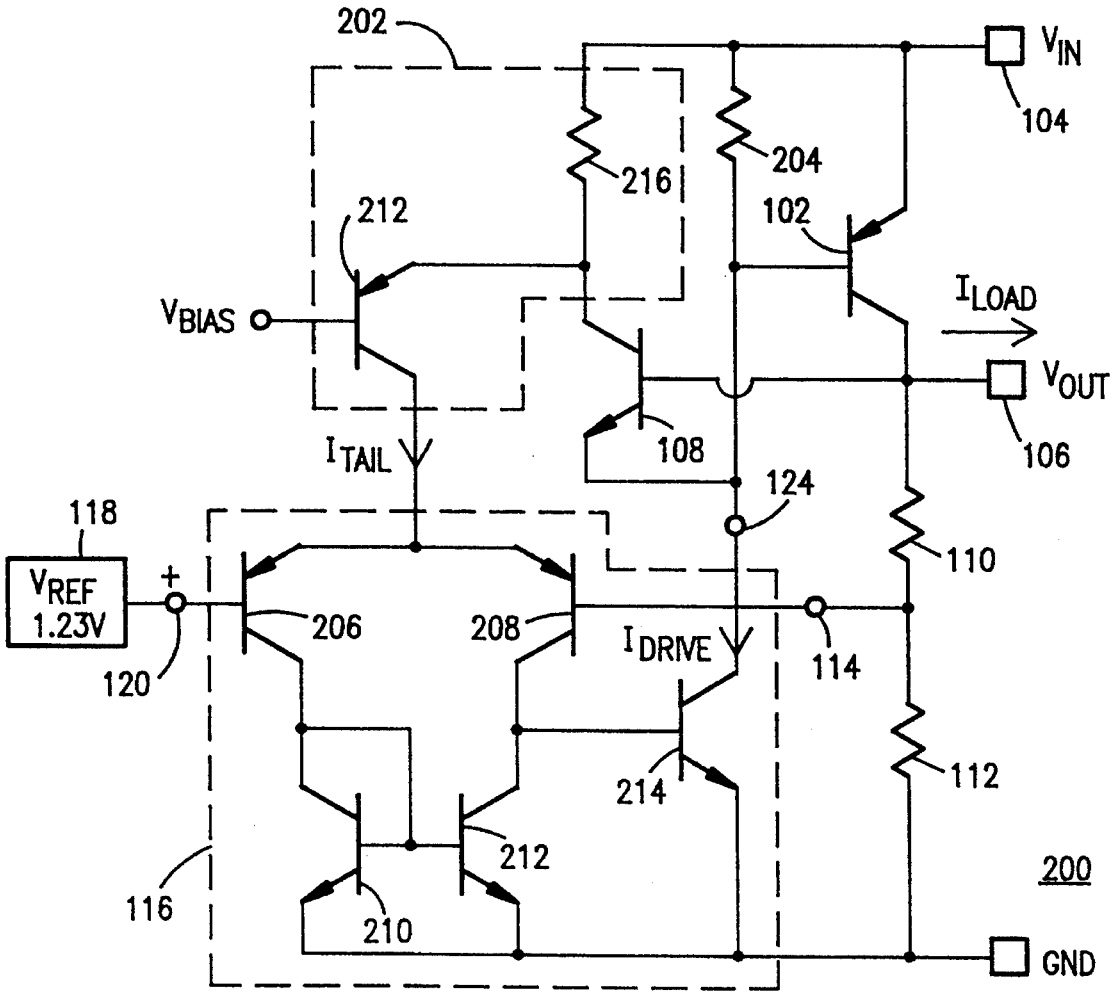
FIG. 3 is a detailed schematic diagram illustrating a first embodiment of the voltage regulator circuit of the invention.

Referring now to FIG. 3, a detailed schematic diagram of a first embodiment of a lateral construction voltage regulator 200 is shown. This voltage regulator 200 is shown in a more detailed form than the voltage regulator 100. When the regulator is shut off, a resistor 204 bleeds off the potential at the base of the output transistor 102 to insure that the potential at the collector of the output transistor 102 drops to zero.

With reference to the control amplifier 116, the control amplifier 116 includes a pair of PNP transistors 206 and 208, with the base of transistor 206 operating as the non-inverting input 120 and the base of the transistor 208 operating as the inverting input 114. Given that the potential at the non-inverting input 120 is fixed (at 1.23 volts in the case of the embodiment shown in FIG. 3), the transistors 206 and 208 together with a pair of NPN transistors 210 and 212 primarily control the potential at the base of the driver transistor 214 in response to the potential at the junction of the resistors 110 and 112. This in turn controls the amount of current flowing through the collector of the driver transistor 214.

The bias current control circuit 202 includes a PNP transistor 212 and a resistor 216. In the embodiment of the invention illustrated in FIG. 3, the value of the resistor 216 and the value of the bias voltage, $V_{BIAS}$, at the base of transistor 212 are selected to achieve a particular value of tail current, $I_{TAIL}$. This tail current flows into the emitter of each of the transistors 206 and 208, and in part determines the level of drive current provided by the driver transistor 214 as well as the bandwidth and gain of the control amplifier 116.

In operation, the parasitic NPN transistor 108 prevents the quiescent current from the voltage supply 104 from surging when the output transistor 102 is saturated and the load across the output port 106 is non-existent or very light. The driver transistor 214 draws current from the base of the output transistor 102 as needed in order to maintain a constant voltage at the voltage output port 106. When the potential of the voltage source 104 is sufficiently higher than the desired potential at the output port 106 and the current flowing from the voltage output port 106 is minimal or zero, the voltage across resistor 204 is approximately equal to the base-emitter voltage of the output transistor 102, which means that very little current flows through the resistor 204.

When the potential of the voltage source 104 drops, the output transistor 102 saturates. In response, the driver transistor 214 attempts to keep the potential at the voltage output port 106 constant by increasing the current through the collector of driver transistor 214. The majority of the extra current, however, flows from the emitter of the parasitic NPN transistor 108 into the control amplifier 116 instead of from the base of the output transistor 102, and this current in turn develops a larger potential across the resistor 216, which thereby provides negative feedback to the driver transistor 214, decreasing the conduction of the driver transistor 214.

Figure 4:
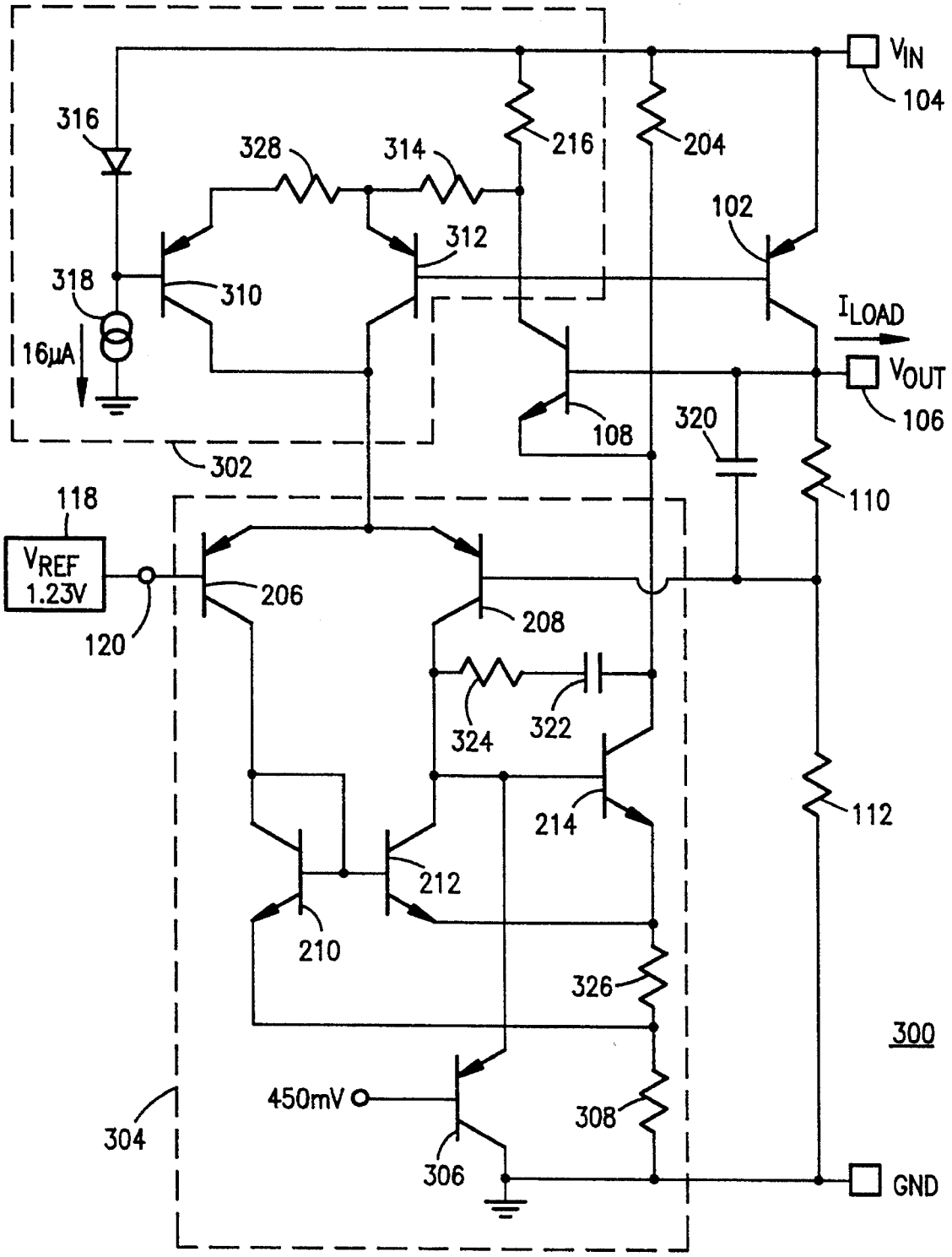
FIG. 4 is a detailed schematic diagram illustrating a second embodiment of the voltage regulator circuit of the invention.

Referring now to FIG. 4, there is shown a detailed schematic diagram of a more elaborate voltage regulator 300 in accordance with the invention. Such regulator 300 is fabricated in the form of an integrated circuit. In contrast to the embodiment of FIG. 3, that of FIG. 4 includes a bias current circuit 302 which provides dynamic biasing of a more elaborate control amplifier 304.

Within the control amplifier 304, a transistor 306 acts as a voltage clamp at the base of the driver transistor 214 to thereby restrict the amount of current that driver transistor 214 can supply when the output transistor 102 is not saturated. In addition a resistor 308 further limits the current which can flow through the emitter of driver transistor 214. In the preferred embodiment of the invention, the potential at the base of transistor 306 is set at 450 millivolts. The transistor 306 and the resistor 308 do not, however, control the base of the driver transistor 214 when the parasitic NPN transistor 108 begins to conduct. Instead, the base of driver transistor 214 is controlled by the differential transistors 206 and 208 via the feedback path which includes transistor 108.

In the bias current circuit 302, a transistor 310 roughly corresponds to the transistor 212 of FIG. 3, in that they each supply a fixed bias current level to the control amplifier 304. However, in the embodiment of FIG. 4, the transistor 310 operates together with a transistor 312 to dynamically bias the control amplifier 304. The level of current flowing through transistor 312 tracks the level of current through the output transistor 102, but because of the voltage drop across the resistor 216 and a resistor 314 the base-emitter voltage of transistor 312 does not increase millivolt for millivolt with the base-emitter voltage of output transistor 102. Thus, there is a slower logarithmic growth in the scaled current flowing through transistor 312. The current growth is, however, adaptive to the growth in current through the output transistor 102.

Referring again to the bias current source 302, a forward biased diode 316 together with a current source 318, which in this preferred embodiment of the invention is selected to provide 16 microamperes of current, establishes the bias at the base of transistor 310. When the voltage regulator 300 is first powered from the voltage source 104, transistor 312 does not conduct, however, transistor 310 operates at a fixed bias level, and that bias level causes driver transistor 214 to conduct. The conduction of driver transistor 214 in turn causes output transistor 102 to conduct thereby providing a potential at the voltage output port 106. At this point in time, the adaptive bias provided by transistor 312 begins to dominate the bias provided to output transistor 102. Specifically, transistor 312 begins to conduct and draws current through resistors 216 and 314. The resultant voltage drop across resistors 216 and 314 begins to decrease the total base-emitter voltage of transistor 310.

A very small capacitor 320 which is in parallel with the resistor 110 provides frequency compensation to prevent instability due to the phase lag of the stray capacitance at the base of transistor 208. A capacitor 322 and a resistor 324, which are connected in series between the collectors of transistors 208 and 214 provide the primary frequency compensation within the differential amplifier 304. A resistor 326, which is connected between the junction of the emitters of transistors 212 and 214 and the junction of the resistor 308 and the emitter of transistor 210 functions to improve the load regulation by sensing a current that is proportional to the current drawn by the external load. In response, the resistor 326 introduces a small potential across the emitters of transistors 210 and 212 to compensate for a drop in potential at voltage output port 106.

Referring again to the bias current circuit 302, a resistor 328 is connected between the emitters of transistors 310 and 312 and operates to reduce the level of current through transistor 310.

Figure 5:
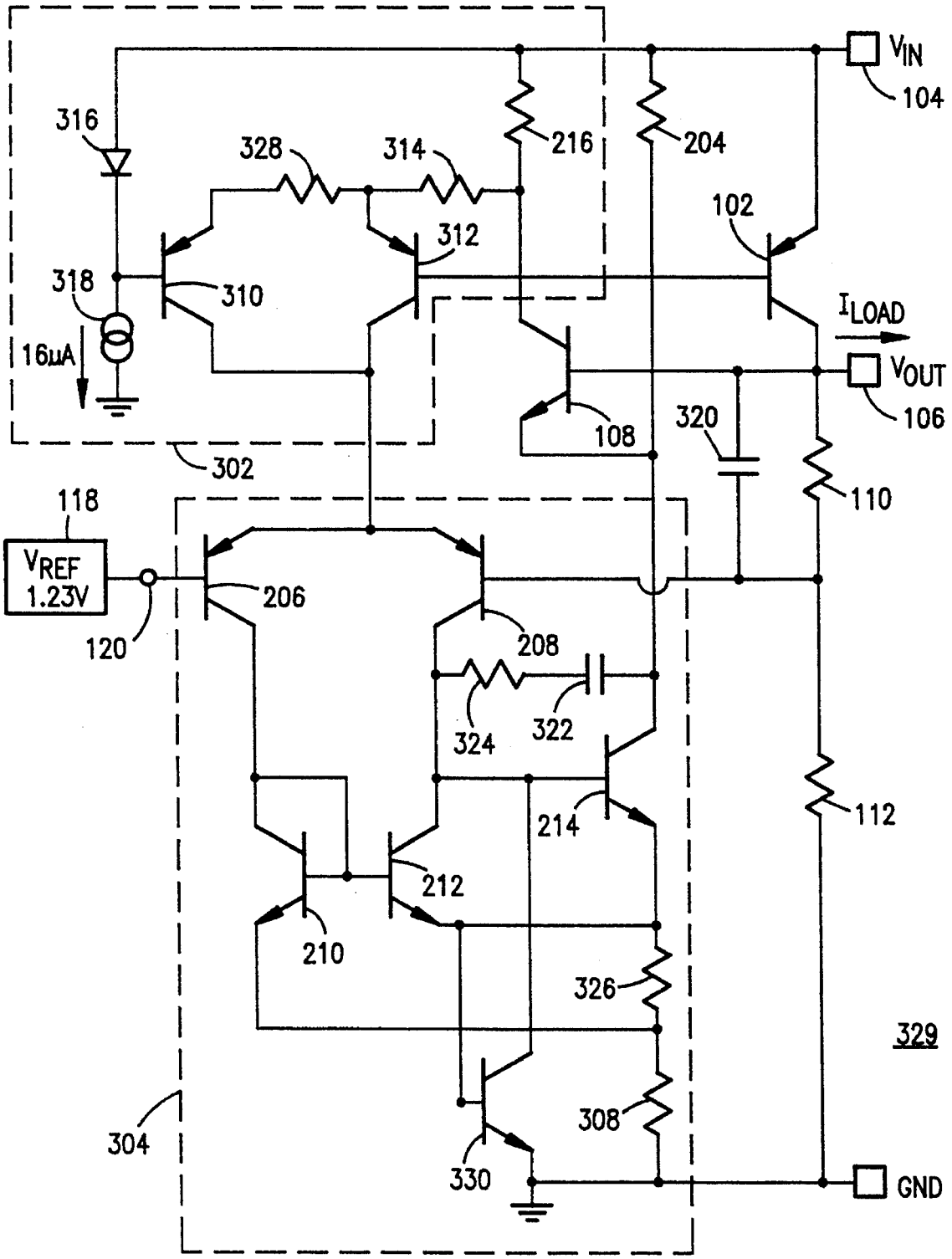
FIG. 5 is a detailed schematic diagram illustrating a third embodiment of the voltage regulator circuit of the invention.

FIG. 5 illustrates a third embodiment 329 of the voltage regulator circuit of the invention wherein the PNP transistor 306 of FIG. 4 has been replaced by a NPN transistor 330.

In the embodiment of FIG. 4, the voltage level at which clamping is provided by transistor 306 is determined primarily by the bias potential at the base of transistor 306. In the embodiment of FIG. 5, however, the voltage level at which clamping is provided by transistor 330 is set by the base-emitter voltage of the transistor 330. Thus, the level is set from within the control amplifier 304 instead of externally as is the case with the embodiment 300 of FIG. 4.

Figure 6:
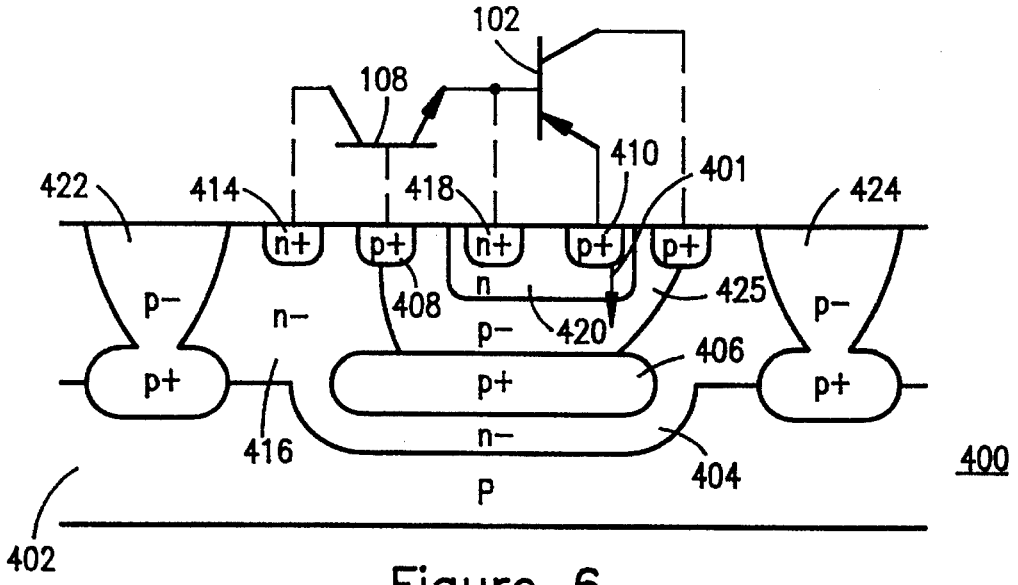
FIG. 6 is a sectional view of a portion of an integrated circuit illustrating the structure and relative locations of a vertical construction PNP output transistor and a parasitic NPN transistor in accordance with the invention.

FIG. 6 illustrates the architecture within a junction isolated integrated circuit 400 which includes vertical PNP output transistor 102 and the merged parasitic NPN transistor 108. PNP output transistor 102 is termed vertical because base current transport in the structure 400 takes place vertically as shown by the arrow 401 in FIG. 6. Vertical PNP transistors have electrical characteristics superior to those of prior art laterally constructed transistors. The output transistor 102 and the parasitic NPN transistor 108, which in FIG. 6 are illustrated schematically solely for purposes of explanation, are built in an isolated n region. As previously detailed the parasitic NPN transistor 108 conducts only when the output transistor 102 saturates. In addition, because of the architecture, the parasitic NPN transistor 108 is both thermally and physically coupled to the output transistor 102, an adaptive threshold for sensing the saturation point of the output transistor 102 is thereby provided. In further detail, the saturation point of the transistor 102 is temperature and dopant level dependant. Since the collector and base regions of the output transistor 102 are the same as the base and emitter regions, respectively, of the parasitic NPN transistor 108, any temperature or dopant differential between the output transistor 102 and the NPN parasitic transistor 108 is insignificant. As a result, the transconductance characteristics of the NPN parasitic transistor adapt to the saturation point of the output transistor as the temperature of the output transistor varies and from fabrication lot to fabrication lot.

In further detail, a p-type substrate 402 has an epitaxial layer 416 and up/down p-type junction isolating diffusions 424 and 422, respectively. An n-well diffusion 404 creates a recess for the electrical isolation of P+ diffusion 406 within the epitaxial pocket defined by epitaxial layer 416, n-well 404, and the p-type regions 422 and 424. A p-well region 425 is formed by diffusing dopant from the surface in the same processing step used to form top isolation regions 422. P-well region 425 forms the collector of PNP output transistor 102 and base of NPN sense transistor 108. P+ diffusion 412 facilitates ohmic contact to the interconnect metalization and serves to reduce PNP collector resistance. An n-type diffusion 420 into P-well 425 forms the base of output transistor 102 and the emitter of sense transistor 108. N+ diffusion 418 facilitates ohmic contact to the interconnect metalization. P+ diffusion 410 forms the emitter of output transistor 102. N+ diffusion 414 facilitates ohmic contact to the epitaxial layer 416. Epitaxial layer 416 is biased at a potential higher than the P-well 425 so as to insure a reversed biased junction. In serving simultaneously as the collector of sense transistor 108, the invention maintains this desired condition. No additional diffusion nor any modification of processing is required to fabricate the fully merged sense transistor 108.

In an integrated circuit implementation of the embodiments shown in FIGS. 4 and 5, the following component values have been found satisfactory for an operative voltage regulator. Unless otherwise specified all resistor values are in ohms and all capacitor values are in picofarads:

| Reference No. | Type | Value |
|---|---|---|
| 110 | Resistor | 180K |
| 112 | Resistor | 60K |
| 204 | Resistor | 100K |
| 216 | Resistor | 600 |
| 308 | Resistor | 200 |
| 314 | Resistor | 1.5K |
| 320 | Capacitor | 2 |
| 322 | Capacitor | 5 |
| 324 | Resistor | 15K |

It is apparent from the foregoing that a new and improved method and circuit have been provided for the control of saturation current in vertical structure voltage regulators. While the invention has been described with respect to a PNP output transistor and an NPN parasitic transistor, a complementary (i.e., NPN devices in place of PNP devices, and vice-versa) implementation of the invention would be operative. Thus, while only certain preferred embodiments have been described in detail, as will be apparent to those familiar with the art, certain changes and/or modifications can be made without departing from the scope of the invention as defined by the following claims.

I claim:

1. A voltage regulator circuit comprising:

a vertical structure PNP transistor having an emitter, a base and a single collector, the emitter coupled to a voltage supply and the collector coupled to a load;

reference means for setting a desired potential provided by the single collector of the vertical structure PNP transistor to the load;

feedback means for sensing the potential across the load and generating a signal for controlling, through the base of the vertical structure PNP transistor, an amount of current flowing through the collector current of the vertical structure PNP transistor; and saturation sensing means coupled to the vertical structure PNP transistor, operative to retard the signal generated by the feedback means when the vertical structure PNP transistor saturates.

2. The voltage regulator circuit of claim 1, wherein the reference means further comprises:

a fixed potential source.

3. The voltage regulator circuit of claim 1, wherein the feedback means comprises a differential amplifier.

4. The voltage regulator circuit of claim 1, wherein the saturation sensing means further comprises:

an NPN transistor formed within a substrate.

5. A voltage regulator circuit comprising:

a vertical structure PNP transistor formed within a substrate, having an emitter, a base and a single collector, the emitter coupled to a voltage supply and the collector coupled to a load;

reference means for setting a desired potential provided by the single collector of the vertical structure PNP transistor to the load;

feedback means for sensing the potential across the load and generating a signal for controlling, through the base of the vertical structure PNP transistor, an amount of current flowing through the collector of the vertical structure PNP transistor; and saturation sensing means formed within the substrate, the saturation sensing means sharing at least one common region with the vertical structure PNP transistor, operative to retard the signal generated by the feedback means when the vertical structure PNP transistor saturates.

6. The voltage regulator circuit of claim 5, wherein the reference means further comprises:

a fixed potential source.

7. The voltage regulator circuit of claim 5, wherein the saturation sensing means further comprises:

an NPN transistor including a base-emitter region which also operates as a collector-base region of the vertical structure PNP transistor.

8. A voltage regulator circuit comprising:

a vertical structure transistor formed within a substrate, having its emitter coupled to a voltage supply and its collector coupled to a load;

reference means for setting a desired potential provided by the vertical structure transistor to the load;

feedback means for sensing the potential across the load and generating a signal for controlling through the base of the vertical structure transistor the collector of the vertical structure transistor, the feedback means comprising a driver transistor having its collector coupled to the base of the vertical structure transistor, operative to sense a drop in potential at the load and in response thereto to increase the current from the base of the vertical structure transistor; and saturation sensing means formed within the substrate, the saturation sewing means sharing at least one common region with the vertical structure transistor, operative to retard the signal generated by the feedback means when the vertical structure transistor saturates.

9. A voltage regulator circuit comprising:

a vertical structure output transistor formed within a substrate, having an emitter, a base and a single collector, the emitter coupled to a voltage supply and the single collector coupled to a load;

reference means for setting a desired potential provided by the single collector of the vertical structure output transistor to the load;

feedback means for sensing the potential across the load and generating a signal for controlling, through the base of the vertical structure output transistor, an amount of current flowing through the collector of the vertical structure output transistor; and a saturation sensing transistor formed within the substrate, an emitter of the saturation sensing transistor operative as the base of the output transistor, the saturation sensing transistor operative to retard the signal generated by the feedback means when the vertical structure output transistor saturates.

10. The voltage regulator circuit of claim 9, wherein the reference means further comprises:

a fixed potential source.

11. The voltage regulator circuit of claim 9, wherein the feedback means comprises:

a differential amplifier having a first input coupled to the reference means and a second input coupled to the single collector of the vertical structure output transistor.

12. The voltage regulator circuit of claim 9, wherein the vertical structure output transistor comprises:

a PNP transistor.

13. A method of regulating the potential provided to a load comprising the steps of:

coupling a voltage supply to a load through a vertical structure PNP transistor formed within a substrate, the vertical structure PNP transistor having an emitter, a base and a single collector, the emitter coupled to a voltage supply and single collector coupled to a load;

setting a desired potential to be provided by the single collector of the vertical structure PNP transistor to the load;

sensing the potential across load and generating a signal for controlling, through the base of the vertical structure PNP transistor, an amount of current flowing through the collector of the vertical structure PNP transistor; and sensing saturation within the vertical structure PNP transistor, and in response thereto retarding the signal for controlling the amount of current flowing through the collector of the vertical structure PNP transistor.

14. The method of claim 13, wherein generating a signal for controlling further comprises the steps of:

dividing the potential across the load; and comparing the divided potential to a reference potential.

15. The method of claim 13, wherein sensing saturation within the vertical structure PNP transistor further comprises the step of:

thermally sensing the vertical structure PNP transistor and in response thereto adjusting the level of the signal for controlling the amount of current flowing through the collector of the vertical structure PNP transistor.

16. The method of claim 15, wherein thermally sensing further comprises the step of:

thermally sensing the collector-base region of the vertical structure PNP transistor.

17. A method of regulating the magnitude of current drawn by a voltage regulator from a voltage supply comprising the steps of:

coupling a voltage supply to a load through a vertical structure transistor formed within a substrate, the vertical structure transistor having an emitter, a base and a single collector, the emitter coupled to the voltage supply and the collector coupled to the load;

sensing a potential across the load, comparing the sensed potential to a reference potential, the reference potential representative of a desired potential, and generating a control signal for controlling, through the base of the vertical structure transistor, an amount of current flowing through the collector of the vertical structure transistor;

sensing saturation within the vertical structure transistor with a thermally coupled parasitic transistor, an emitter of the thermally coupled parasitic transistor also operating as the base of the vertical structure transistor, and in response to sensed saturation, rerouting at least a portion of the control signal; and decreasing the total magnitude of the control signal in response to the rerouting of the signal.

18. A method of regulating the magnitude of current drawn by a voltage regulator from a voltage supply comprising the steps of:

coupling a voltage supply to a load through a vertical structure transistor formed within a substrate, the vertical structure transistor having an emitter, a base and a single collector, the emitter coupled to the voltage supply and the collector coupled to the load;

sensing a potential across the load, comparing the sensed potential to a reference potential, the reference potential representative of a desired potential, and generating a control signal from a control amplifier for controlling, through the base of the vertical structure transistor, an amount of current flowing through the collector of the vertical structure transistor;

sensing saturation within the vertical structure transistor with a thermally coupled parasitic transistor, an emitter of the thermally coupled parasitic transistor also operating as the base of the vertical structure transistor, and in response to sensed saturation, rerouting at least a portion of the control signal; and decreasing the total magnitude of the control signal in response to the rerouting of the signal by decreasing operating currents within the control amplifier.

19. A method of regulating the magnitude of current drawn by a voltage regulator from a voltage supply comprising the steps of:

coupling a voltage supply to a load through a vertical structure transistor formed within a substrate, the vertical structure transistor having an emitter, a base and a single collector, the emitter coupled to the voltage supply and the collector coupled to the load;

sensing a potential across the load, comparing the sensed potential to a reference potential, the reference potential representative of a desired potential, and generating a control signal from a control amplifier for controlling through the base of the vertical structure transistor, an amount of current flowing through the collector of the vertical structure transistor;

sensing saturation within the vertical structure transistor with a thermally coupled parasitic transistor, an emitter of the thermally coupled parasitic transistor also operating as the base of the vertical structure transistor, and in response to sensed saturation, rerouting at least a portion of the control signal; and decreasing the total magnitude of the control signal in response to the rerouting of the signal by reducing a tail current fed to the control amplifier.

20. A method of regulating the magnitude of current drawn by a voltage regulator from a voltage supply comprising the steps of:

coupling a voltage supply to a load through a vertical structure transistor formed within a substrate, the vertical structure transistor having an emitter, a base and a single collector, the emitter coupled to the voltage supply and the collector coupled to the load;

sensing a potential across the load, comparing the sensed potential to a reference potential, the reference potential representative of a desired potential, and generating a control signal from a control amplifier for controlling through the base of the vertical structure transistor, an amount of current flowing through the collector of the vertical structure transistor;

sensing saturation within the vertical structure transistor with a thermally coupled parasitic transistor, an emitter of the thermally coupled parasitic transistor also operating as the base of the vertical structure transistor, and in response to sensed saturation, rerouting at least a portion of the control signal; and decreasing the total magnitude of the control signal in response to the rerouting of the signal by sensing the level of current flowing through a collector of the thermally coupled parasitic transistor, and in response to an increase in such level, decreasing a tail current fed to the control amplifier.

* * * * *

UNITED STATES PATENT AND TRADEMARK OFFICE

CERTIFICATE OF CORRECTION

PATENT NO. : 5,548,205
DATED : August 20, 1996
INVENTOR(S) : DENNIS MICHAEL MONTICELLI It is certified that error appears in the above-identified patent and that said Letters Patent is hereby corrected as shown below:

In Col. 8, line 29, delete "sewing" and replace with --sensing--.

Signed and Sealed this

Third Day of November, 1998

*Attest:*

*Attesting Officer*

Bruce Lehman

BRUCE LEHMAN

*Commissioner of Patents and Trademarks*